United States Patent [19]

Dickensheets et al.

[11] 3,935,290

[45] Jan. 27, 1976

[54] CARBURETOR COLD ENGINE FUEL ENRICHMENT SYSTEM

[75] Inventors: William E. Dickensheets; Albert A. Pruchno, both of Southfield, Mich.

[73] Assignee: Ford Motor Company, Dearborn, Mich.

[22] Filed: Aug. 5, 1974

[21] Appl. No.: 491,597

[52] U.S. Cl. ..... 261/39 B; 261/44 R; 261/50 A; 261/50 AA; 261/DIG. 56

[51] Int. Cl.[2] ..... F02M 1/06

[58] Field of Search ..... 261/41 D, 50 AA, 50 A, 261/DIG. 56, 44 R, 39 B; 123/187.5 R

[56] References Cited

UNITED STATES PATENTS

| | | | |
|---|---|---|---|
| 2,074,471 | 3/1937 | Holley et al. | 261/39 D |
| 2,084,489 | 6/1937 | Hess | 261/44 R |
| 2,098,202 | 11/1937 | Weber | 261/50 AA |
| 2,264,996 | 12/1941 | Messinger, Jr. | 261/39 D |
| 3,272,487 | 9/1966 | Cook et al. | 261/50 A |
| 3,273,871 | 9/1966 | Winkler | 261/DIG. 67 |
| 3,278,171 | 10/1966 | Carlson | 261/50 A |
| 3,351,327 | 11/1967 | Simonet et al. | 261/50 A |

*Primary Examiner*—Tim R. Miles

*Attorney, Agent, or Firm*—Robert E. McCollum; Keith L. Zerschling

[57] ABSTRACT

A variable area venturi carburetor has the cold engine cranking and running circuits integrated with the venturi valve circuit, to simplify the construction as compared to known carburetors of this type in which the circuits are independent, the integration being provided by an articulated linkage moving the venturi valve in response to engine manifold vacuum changes, the carburetor having an auxiliary air and fuel passage also controlled by manifold vacuum during cold engine operation to provide controlled air and the extra fuel required for cold cranking and running, and shutting down of the extra fuel supply and opening the air supply when the engine reaches the normal operating temperature.

7 Claims, 4 Drawing Figures

CARBURETOR COLD ENGINE FUEL ENRICHMENT SYSTEM

This invention relates, in general, to a variable area venturi type carburetor. More particularly, it relates to one in which the engine cranking and running cold engine fuel enrichment circuits, as well as the venturi valve circuits, are integrated.

U.S. Ser. No. 430,956, "Carburetor Cold Enrichment Fuel Metering Signal and Air Flow Modulator," Dickensheets et al., filed Jan. 4, 1974 and assigned to the assignee of this case, shows and describes a variable area venturi type of carburetor that has a cold engine cranking circuit that is separate from the cold engine running circuit and the circuit for moving the venturi valve to its various positions. The separate circuits necessitate the use of many individual components, such as, for example, solenoid means for opening and closing the engine cranking circuit, that could be eliminated were the various circuits to be integrated as is proposed by this invention.

It is, therefore, a primary object of this invention to integrate the cold engine cranking and running and venturi valve circuits for a variable area venturi type carburetor to simplify the construction while at the same time providing all of the functions of each individual circuit.

It is a further object of the invention to provide a variable area venturi type carburetor with a venturi having at least one movable wall that is actuated by mechanical linkage controlled by engine manifold vacuum changes and temperature responsive stop means to variably enlarge and contract the venturi area to control both air flow and fuel flow through the venturi, the carburetor including an auxiliary air input to the induction passage containing a supplemental fuel passage, supply of air to the auxiliary passage being blocked during cold engine cranking operations to enrich the mixture to the cranking level required by means of a temperature controlled needle valve operable in the auxiliary fuel passage, attainment of a running condition by the engine opening the auxiliary air inlet and bleeding air into the fuel passage to lessen the fuel flow through the auxiliary passage, the venturi valve meanwhile simultaneously opening in response to engine running operation to increase the main fuel flow and air flow to provide an overall leaner mixture than during cranking operation.

Figure 1:
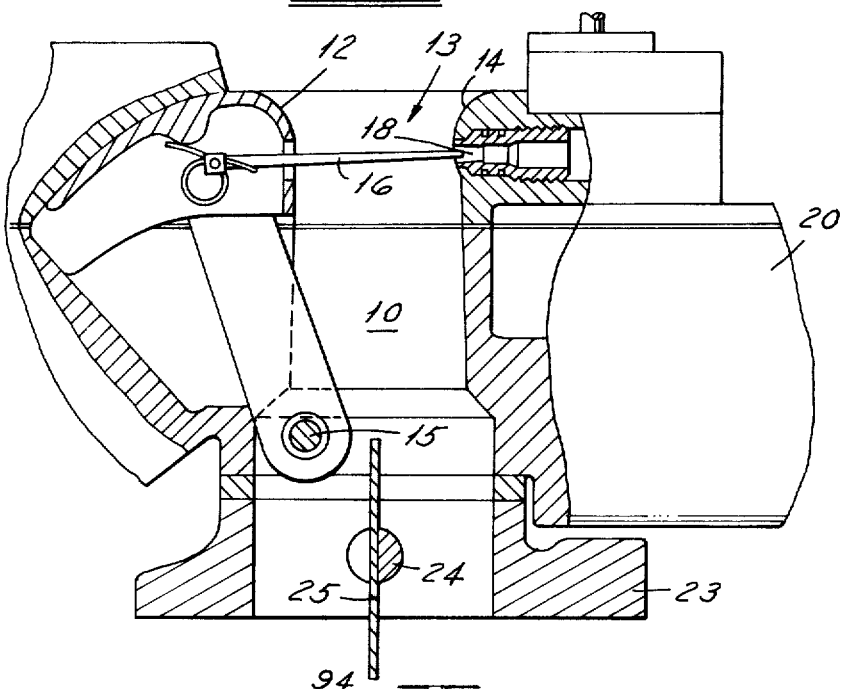
Figure 3:
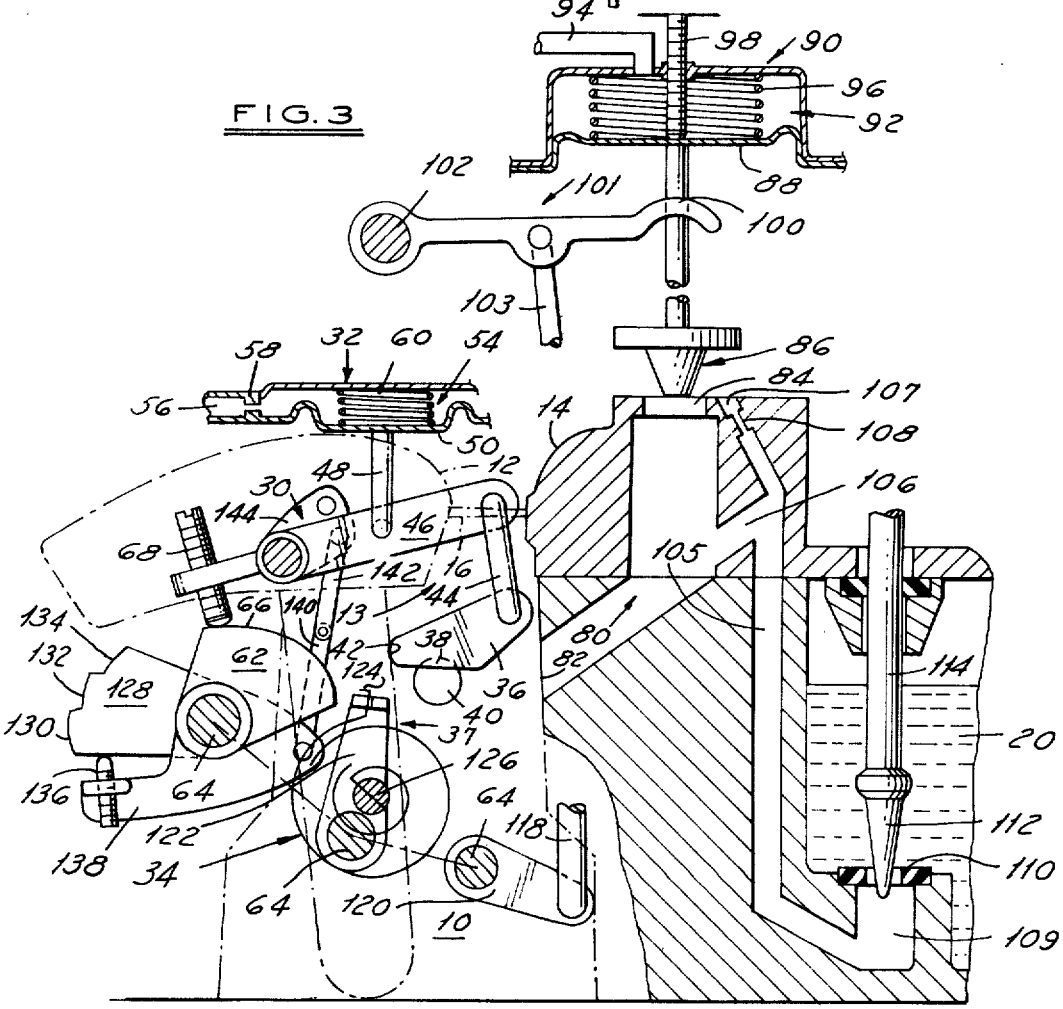
Figure 2:
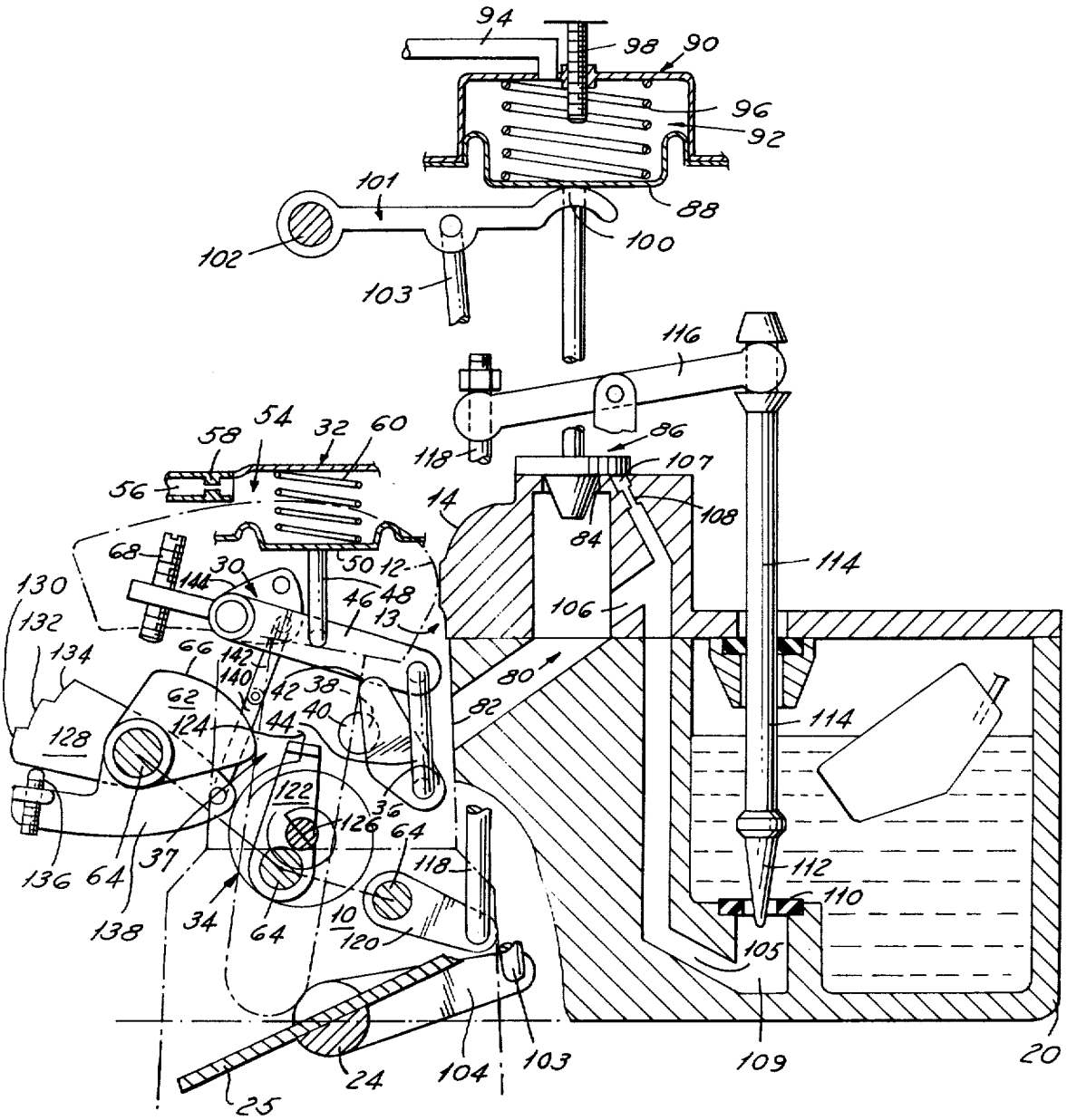
Figure 4:
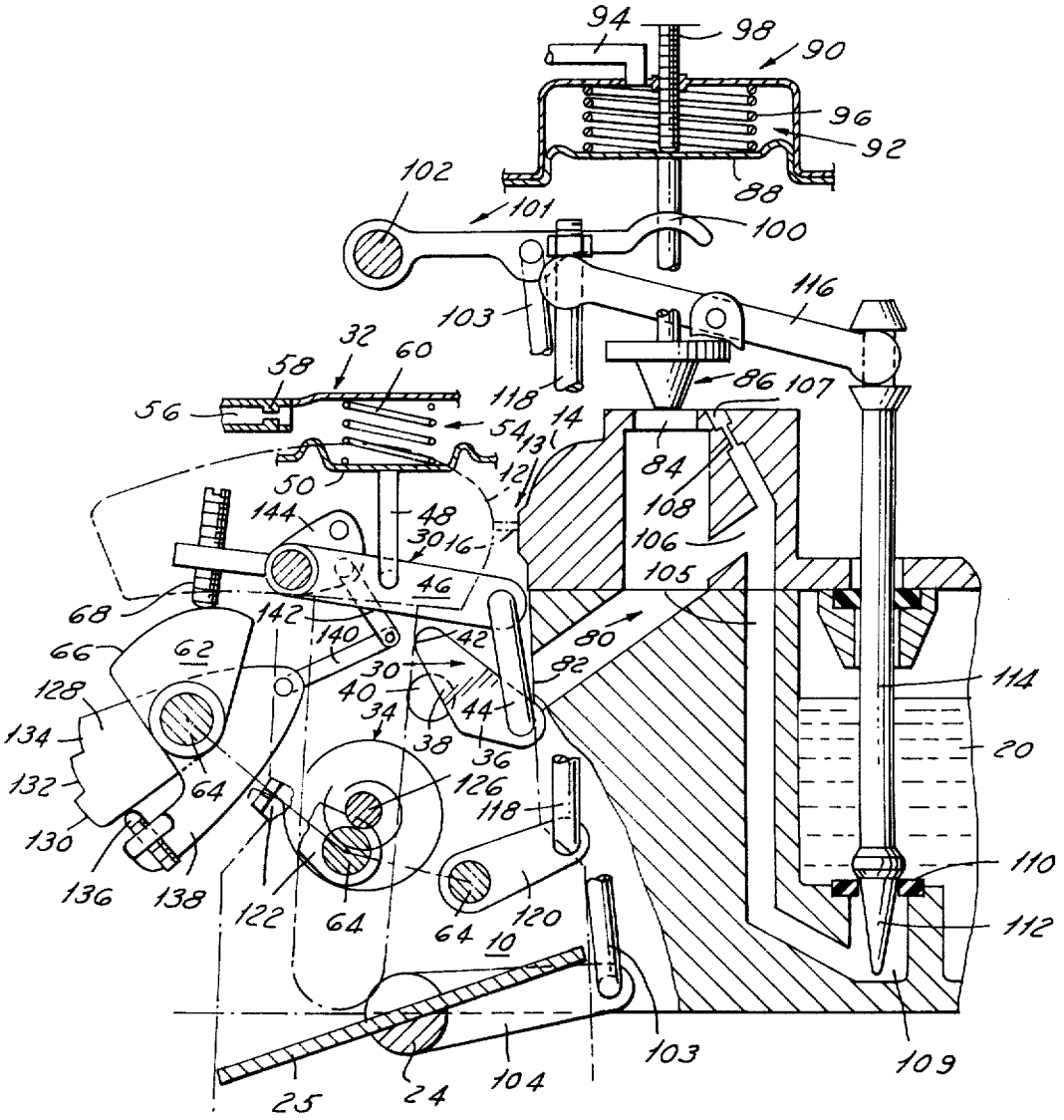

Other objects, features and advantages of the invention will become more apparent upon reference to the succeeding detailed description thereof, and to the drawings illustrating the preferred embodiment thereof; wherein, FIG. 1 is a cross-sectional view of a portion of a variable area venturi type carburetor embodying the invention;

FIG. 2 illustrates schematically an exploded view of the cold engine cranking, running and venturi valve fuel enrichment circuits embodying the invention; and, FIGS. 3 and 4 are views corresponding to that shown in FIG. 2 and illustrating the parts therein in their positions during other conditions of operation of the engine.

FIG. 1, which is essentially to scale, shows a cross-sectional view of a variable area venturi carburetor of the downdraft type similar to that shown in U.S. Ser. No. 430.956, referred to above. The carburetor in this case has a rectangularly shaped induction passage 10, the one end wall 12 of which is pivotally movable and has the profile of one-half of a venturi 13. The opposite fixed cooperating wall 14 is formed with the mating profile of a portion of a venturi. The air flow capacity, therefore, varies in proportion to the opening movements of wall 12 of the induction passage. The movable wall is pivotally mounted at 15 on a stationary pin. The pin actually is fixed to a strut, not shown, that depends from a section of the upper body of the carburetor.

Pivotally attached to the body of wall 12 is a fuel metering rod 16 that cooperates with a main fuel metering jet 18. The needle type rod has a controlled taper to provide a richer air/fuel mixture at both the lower and higher ends of the venturi opening range. The jet is located in an aperture in side wall 14 at approximately the throat or most constricted section of venturi 13. A fuel float bowl or reservoir 20 has a passage (not shown) conducting fuel to the main metering jet 18. Downstream of the venturi, the carburetor throttle body portion 23 rotatably mounts a shaft 24 on which is fixed a conventional throttle plate 25 that controls the flow of air and fuel through induction passage 10.

Referring now to FIGS. 2, 3 and 4, the size of venturi 13 and the movement of wall 12 is controlled in this case by an articulated linkage 30 in turn controlled by an engine intake manifold vacuum responsive servo 32 and a temperature responsive bimetallic spring element 34. More specifically, the articulated linkage 30 includes a bell crank lever 36 fixed at 38 to a rotary valve positioner or shaft 40. The latter is rotatably mounted in the side walls of the carburetor. The one end 42 of the bell crank lever is adapted to engage the front edge of the movable wall supporting leg 37, for pivoting the movable wall to its various open positions. The opposite end of bell crank lever 36 is pivotally connected to a link 44 in turn pivotally connected to the end of a second lever 46. The latter lever is pivotally connected near its midpoint to a rod or stem 48 fixedly projecting from an annular flexible diaphragm 50. The latter constitutes one portion of the vacuum actuated servo mechanism 32. For simplicity, the details of construction of the servo mechanism have not been shown. Suffice it to say that the servo would have an outer housing providing a hollow interior divided by the diaphragm 50 into an air chamber and a manifold vacuum chamber 54. The air chamber would be connected to atmosphere, while the vacuum chamber 54 is connected to engine intake manifold vacuum in a line 56 past an orifice 58. A spring 60 normally biases the diaphragm 50 downwardly to the position shown in FIG. 2 causing the linkage 30 to assume the position shown permitting closure of the venturi valve movable wall 12.

The opening movement of movable wall 12 in this case is controlled by a valve stop cam 62 that is fixedly mounted on a shaft 64. The cam 62 has a continuously variable cam surface or face 66 adapted to be engaged at times by a screw 68 adjustably mounted in the end of lever 46.

The carburetor main body portion is provided with an auxiliary air bypass passage 80 that has an outlet 82 opening into the induction passage below the venturi 13. The air passage has a separate air inlet 84 on the upstream side of the venturi. The inlet is adapted to be closed by an adjustable valve 86 that is secured for movement with an annular flexible diaphragm 88. The diaphragm forms part of a conventional servo mechanism 90 in which the diaphragm divides the servo into an air chamber on the valve size of the diaphragm and a manifold vacuum chamber 92. The latter is connected by a line 94 to engine intake manifold vacuum. A spring 96 normally biases diaphragm 88 and the air bypass valve to a closed position as indicated in FIG. 2. An adjustable stop 98 is provided for limiting the opening movement of the air bypass valve, for air flow control purposes.

In order to prevent closing of the air bypass valve 86 under low engine manifold vacuum conditions, such as, for example, during heavy accelerations or wide open throttle operation, the diaphragm 88 is prevented from moving to the position shown in FIG. 2 during engine operation by engagement with the end 100 of a lever 101. The lever is pivotally mounted at its opposite end 102 and is connected pivotally at its midpoint to a link 103 pivotally connected to a lever 104 on the throttle shaft 24. Accordingly, when the throttle is depressed near to or to the wide open throttle operating position, lever 104 will rotate counterclockwise to move the lever 101 upwardly into engagement with the diaphragm 88 to maintain it in the position shown in FIG. 3 until the manifold vacuum can again build up to the level necessary for it to maintain the diaphragm in that position by itself.

Air in the bypass passage 80 is mixed with fuel inducted through an auxiliary fuel passage 105 connected to the passage 80 by a port 106. The fuel passage has an air bleed 107 at its upper end that is adapted to be blocked or closed when the air bypass valve 86 is closed. An orifice 108 controls the bleed of air into the fuel passage and therefore the signal acting on the fuel. The lower end of fuel passage 105 connects with a fuel channel 109 that opens into the lower end of the fuel reservoir 20. Fuel flows from the reservoir past a metering orifice or fuel jet 110. The flow of auxiliary fuel into passage 105 is controlled in this case by a tapered needle valve 112 secured to a metering rod 114. The rod is pivotally secured to the end of a rockable lever 116 connected at its opposite end to an additional rod 118 pivotally attached to a lever 120. Lever 120 is fixed on shaft 64 and therefore rotates in one direction or the other as a function of changes in temperature of the bimetallic spring element 34, to be described. The flow of auxiliary fuel into fuel passage 105, therefore, will vary as a function of temperature changes by the temperature spring element 34 moving the needle valve 112 into or out of the metering jet.

As stated, shaft 64 fixedly mounts both lever 120 and valve stop cam 62. Also fixed on the shaft is a lever 122 that has a right angled end portion engaging the outer end 124 of the coiled bimetallic spring 34. The inner end of the spring is fixed to a stub shaft 126 that is separate from shaft 64. The coiled spring contracts and expands circumferential in response to changes in temperature from the warm engine level. As the temperature decreases, therefore, from the normal operating level, the outer end of the coiled spring will rotate clockwise to rotate shaft 64 in the same direction. This will position the valve stop cam 62 as shown in FIG. 2 for the coldest engine start or cranking position in which the metering valve 112 is in wide open position. As soon as the engine is cranked, therefore, manifold vacuum acting in the servo 32 will pull the articulated linkage 30 upwardly as shown in FIG. 3 using the engagement of the screw 68 against the lowest portion of the cam surface 66 as a pivot point to open the venturi valve movable wall 12 as shown. As the temperature progressively increases toward the normal operating level, the counterclockwise rotation of the coiled spring 34 will rotate shaft 64 and cam 62 in the same direction to progressively raise the screw 68. Thus, the changing of the pivot point location by rotation of the valve stop cam will permit a progressive closing of the venturi valve movable wall as shown in FIG. 4.

During cold engine cranking positions, it is necessary to crack open the throttle plates from their closed positions to allow sufficient extra air and fuel flow through the induction passage at this time to compensate for the increased friction, oil viscosity, etc. This is accomplished by the conventional fast idle cam mechanism shown here only partially. More specifically, the shaft 64 rotatably mounts a fast idle cam 128 having a number of steps 130, 132, and 134 of different radial extent. The steps are adapted to be engaged one at a time by a screw mechanism similar to that of 68 that would be attached to a lever fixed to the throttle shaft 24. It will be clear, therefore, that depending upon the rotated position of the fast idle cam, the closed position of the throttle plates will vary as a function of which step the throttle shaft mounted screw mechanism is engaging. For example, when the screw is engaging the step 134, the throttle plates 25 will be in their normal closed idle speed position shown In FIG. 4. On the other hand, with a cold engine start, the step 130 will be engaged by the screw to provide the greatest opening of the throttle plates, as seen in FIG. 2, to provide the required air flow at this time.

It should be noted that the end 100 of lever 101 is constructed to just touch the underside of diaphragm 88 in its extended position when the throttle plates 25 and lever 104 are rotated to the coldest engine start position shown. This permits closure of valve 86 without regard to the closed idle speed position of the throttle plates 25.

As stated, the fast idle cam 128 is rotatably mounted on shaft 64. This permits the cam to fall by gravity against a screw 136 adjustably mounted on a lever 138. The fast idle cam, therefore, will normally follow the movement of lever 138 once the step of the cam is released from engagement by the throttle shaft mounted screw, not shown. This is necessary to permit an override of the fast idle cam action upon full depression of the throttle plates in a conventional manner to reposition the fast idle cam for a fast or hot engine start, for example, in a known manner. This will become clear later during a description of the operation.

Lever 138 is fixed on shaft 64 and, therefore, normally rotates as a function of changes in temperature of bimetallic element 34. To accomplish the conventional kick down or release from the high cam step after engine cranking, lever 138 is pivotally connected by jointed links 140 and 142 to a lever 144. The latter is fixed to link 46 and, therefore, pivots with it. When the carburetor linkage is conditioned for cranking, as seen in FIG. 2, servo spring 60 will move linkage 30 and lever 138 to position fast idle cam 128 up. This will present step 130 for engagement by the throttle shaft mounted screw, not shown, cracking open the throttle plate 25 to the fastest idle speed position, for starting. As soon as the engine attains a running condition, servo 32 then retracts linkage 30 to the FIG. 3 position, moving lever 138 to the position shown. The fast idle cam 128, however, will not fall down by gravity against screw 138 until the throttle shaft is rotated open enough to free the step 130 from the throttle shaft mounted screw.

Conversely, to restart an engine, lever 138 cannot move the fast idle cam up (assuming it is in the FIG. 4 position) to the FIG. 2 cranking position until the throttle plates are opened to a position releasing the throttle shaft mounted screw from the fast idle cam step 134.

In operation, a cold engine start is obtained by first depressing the accelerator pedal to release the fast idle cam 128 from the throttle shaft mounted screw so that the cam can assume the position dictated by lever 138. The step 130 will be engaged by the throttle shaft mounted screw to open the throttle plates wider than their normal engine idle speed position. At the same time, with no manifold vacuum present, servo spring 60, in addition to positioning the fast idle cam, will move the articulated linkage 30 to the position shown in FIG. 2 to close the venturi valve 12 to the position shown. While it appears to be completely closed, sufficient air leakage exists around the sides of the venturi valve and past the nose portion to provide the required air flow. The valve stop cam 62 has been rotated to the position shown by shaft 64 being rotated by coiled spring 34. Simultaneously, the lack of manifold vacuum to servo 90 will permit the spring 96 to close the air bypass valve 86, which also closes the air bleed 107 for fuel passage 105. The maximum fuel metering signal therefore will be present in passage 106 to induct the correct amount of fuel into the engine during the cranking operation. The needle valve 112 has been withdrawn its maximum amount by the rotation of shaft 64 and lever 120 by the coiled bimetallic spring 34, as described previously. Accordingly, the engine is now conditioned for cranking operations with a rich mixture and reduced auxiliary air flow input openings but increased air flow past the throttle plates.

Referring now to FIG. 3, as soon as the engine attains a running condition, the buildup in manifold vacuum immediately raises the articulated linkage 30 and lever 138 to the positions shown causing the lever 36 to pivot counterclockwise and move open the venturi valve 12 to the position shown. The lever 46 pivots about the screw 68 seated against the lower portion of the cam surface 66. Simultaneously, manifold vacuum acting in servo 90 pulls open the air bypass valve 86 and increases the air input supply to the induction passage. It also uncovers the air bleed 107 to fuel passage 105. This results in a decreased auxiliary fuel supply signal thereby resulting in less inducted auxiliary fuel, while simultaneously increasing the main fuel flow by withdrawal of metering rod 16 from the main metering orifice 18. Simultaneously, depression of the throttle plate 25 will move the throttle shaft mounted screw away from the fast idle cam step 130 permitting rotation of the cam down against screw 136. Release of the accelerator pedal then will cause engagement of a lower step 132 on the cam 128, closing the throttle plate to a less open position but still greater than the normal engine idle speed position. This also decreases the air flow. The overall effect is to provide a leaner engine running mixture than during the cranking operation since less fuel is now needed.

As the engine continues to run and the temperature continues to increase towards the normal operating level, the fast idle cam and the valve stop cam 62 will be rotated counterclockwise in response to the warming movement of the coiled spring 34 so that the positions shown in FIG. 4 are eventually attained. The screw 68 has been raised by its engagement with the highest portion of the valve stop cam 62 so that the lever 36 is rotated to the position shown and permits closing of the venturi valve. Simultaneously, the fuel metering rod valve 112 has been moved downwardly to seat in the metering jet 110 and completely shut off the flow of auxiliary fuel to passage 106. The air bypass valve 86 remains open and will stay in that position even though low manifold vacuums are encountered during heavy accelerations because of the movement of lever 101 by the throttle valve shaft 24 mechanically maintaining the diaphragm 88 upwardly and the valve 86 open. The cold enrichment system therefore is rendered inoperative.

From the foregoing, therefore, it will be seen that the invention provides a variable area venturi type carburetor with a cold enrichment system that integrates the venturi valve circuit, the cold engine cranking circuit, and the cold engine running circuit, by means of a simplified mechanical construction.

While the invention has been described and illustrated in its preferred embodiment, it will be clear to those skilled in the arts to which it pertains that many changes and modifications may be made thereto without departing from the scope of the invention.

What is claimed is:

1. A combination cold engine cranking and running fuel enrichment system comprising a variable area venturi carburetor having an induction passage connected to fresh air at one end and adapted to be connected to the engine intake manifold at the other end, the passage containing means forming a venturi including a valve movable to vary the venturi area to control airflow through the venturi, a variable area fuel port adjacent the venturi whereby fuel is inducted into the passage during airflow through the venturi, an auxiliary air bypass passage having an outlet connected to the induction passage and having a separate air inlet, a first valve spring biased to close the inlet and responsive to engine operation to move to an open position, a supplemental fuel passage connected to the air bypass passage at one end to a supply of fuel at the other end, a second valve movably cooperating with the fuel supply to block or variably increase the supply of fuel to the supplemental fuel passage, temperature responsive means connected to the second valve for movement of the second valve in opposite directions as a function of changes in temperature from a predetermined level, and control means to vary the area of both the venturi and fuel port on a predetermined schedule to vary fuel flow and normally biasing the venturi valve towards a closed smallest area venturi position and movable in response to engine operation to open positions increasing the area of the venturi anc changing fuel flow, inoperativeness of the engine effecting a movement of the venturi valve to effect closing down of the venturi area and a closing of the first valve to decrease the air supplies to the induction passage and bypass passage upon subsequent engine cranking operation thereby increasing the manifold signal acting on the supplemental fuel passage to enrichen the starting fuel/air mixture to the engine, subsequent running operation of the engine moving the venturi valve to a larger venturi area and the first valve to an open position thereby increasing the fuel inducted from the fuel port while bleeding the manifold signal acting on the fuel passage to decrease fuel flow through the fuel passage and leaning the fuel/air mixture to the engine to provide an overall fuel/air mixture leaner than during engine cranking operations, means connecting an air bleed passage to the supplemental fuel passage and having an orifice therein, the first valve in its closed position covering the air bleed passage, opening of the first valve decaying the vacuum signal acting on the fuel passage.

2. A fuel enrichment system as in claim 1, including override means to maintain the first valve in an open position during low manifold vacuum level accelerations.

3. A fuel enrichment system as in claim 2, including engine manifold vacuum actuated servo means connected to the first valve and to the venturi valve moving the venturi valve in response to engine operation to vary the venturi area as a function of changes in engine vacuum and to move the first valve to a valve open position, and a lever secured to and movable with the engine throttle shaft for engaging the servo means and maintaining the servo means in a first valve open position during engine operation regardless of the engine manifold vacuum level.

4. A fuel enrichment system as in claim 1, the venturi being defined by a movable wall constituting said venturi valve which is movable to enlarge and contract the venturi area, the control means including a manifold vacuum actuated servo and articulated linkage, means connecting the linkage to the servo, the linkage having a portion engaging the movable venturi wall for moving and effecting movement of the same in opposite directions upon changes in engine vacuum levels, the servo including spring means biasing the linkage and movable wall towards a closed venturi position, the linkage including a connection to the temperature responsive means for variably changing the closed position of the venturi movable wall as a function of changes in the temperature below the engine normal operating temperature level to control cold engine fuel enrichment and airflow, a second manifold vacuum actuated servo connected to the first valve for opening the auxiliary air inlet as soon as the engine attains a running condition, the second valve comprising a needle valve movably cooperating with a fuel orifice connecting a fuel reservoir to the fuel passage to vary the flow of fuel to the fuel passage as a function of changes in temperature of the temperature responsive means, the temperature responsive means comprising a bimetallic spring normally exerting an opening force on the second valve that increases variably as the temperature level decreases from the normal engine operating temperature level, the fuel passage having an atmospheric vent opening adjacent the end of the fuel passage that is opposite to the end adjacent the second valve, the vent opening being closed when the first valve is closed and opened in response to opening of the first valve to change the vacuum signal acting in the fuel passage.

5. A fuel enrichment system as in claim 4, the vent opening being covered and closed by the first valve when the first valve is closed, to increase the signal force acting on the fuel passage during engine cranking operations.

6. A fuel enrichment system as in claim 5, including override means operably connected to the second servo and operable in response to a predetermined decay in engine manifold vacuum force during engine operation to prevent closing of the auxiliary air inlet first valve.

7. A combination cold engine cranking and running fuel enrichment system comprising a variable area venturi carburetor having an induction passage connected to fresh air at one end and adapted to be connected to the engine intake manifold at the other end, the passage containing means forming a venturi including a valve movable to vary the venturi area to control airflow through the venturi, a variable area fuel port adjacent the venturi whereby fuel is inducted into the passage during airflow through the venturi, an auxiliary air bypass passage having an outlet connected to the induction passage and having a separate air inlet, a first valve spring biased to close the inlet and responsive to engine operation to move to an open position, a supplemental fuel passage connected to the air bypass passage at one end and to a supply of fuel at the other end, a second valve movably cooperating with the fuel supply to block or variably increase the supply of fuel to the supplemental fuel passage, temperature responsive means connected to the second valve for movement of the second valve in opposite directions as a function of changes in temperature from a predetermined level, and control means to vary the area of both the venturi and fuel port on a predetermined schedule to vary fuel flow and normally biasing the venturi valve towards a closed smallest area venturi position and movable in response to engine operation to open positions increasing the area of the venturi and changing fuel flow, inoperativeness of the engine effecting a movement of the venturi valve to effect closing down of the venturi area and a closing of the first valve to decrease the air supplies to the induction passage and bypass passage upon subsequent engine cranking operation thereby increasing the manifold signal acting on the supplemental fuel passage to enrichen the starting fuel/air mixture to the engine, subsequent running operation of the engine moving the venturi valve to a larger venturi area and the first valve to an open position thereby increasing the fuel inducted from the fuel port while bleeding the manifold signal acting on the fuel passage to decrease fuel flow through the fuel passage and leaning the fuel/air mixture to the engine to provide an overall fuel/air mixture leaner than during engine cranking operations, an engine manifold vacuum actuated servo means connected to the first valve and to the venturi valve moving the venturi valve in response to engine operation to vary the venturi area as a function of changes in engine vacuum and to move the first valve to a valve open position, the control means including mechanical linkage means secured to the venturi valve and movable by the servo means to vary the position of the venturi valve position stop means secured to the linkage means and including movable means operably connected to the temperature responsive means for determining the closed position of the venturi valve as a function of temperature, the movable means including a cam surface providing a variable number of venturi valve closing positions, the linkage means engaging and moving the venturi valve upon changes in manifold vacuum level to positions determined by the temperature responsive means whereby the venturi valve closing position becomes more open and enlarged as the temperature decreases from the normal engine operating level, to increase air and fuel flow through the venturi.

* * * * *